United States Patent [19]

Sullivan et al.

[11] Patent Number: 4,480,594

[45] Date of Patent: Nov. 6, 1984

[54] ECONOMIZER SUPPORT

[75] Inventors: Robert P. Sullivan; Francis B. Jackson, both of Chattanooga, Tenn.

[73] Assignee: Combustion Engineering, Inc., Windsor, Conn.

[21] Appl. No.: 581,847

[22] Filed: Feb. 21, 1984

[51] Int. Cl.[3] ..... F28B 9/00; F22B 37/24

[52] U.S. Cl. ..... 122/510; 165/162; 165/172; 122/DIG. 16

[58] Field of Search ..... 122/510, 512, DIG. 16; 165/162, 172

[56] References Cited

U.S. PATENT DOCUMENTS

| | | | |
|---|---|---|---|
| 3,545,534 | 12/1970 | Coles | 165/162 |
| 3,854,529 | 12/1974 | Sagan | 165/162 |
| 3,998,268 | 12/1976 | Sagan | 122/510 |
| 4,337,827 | 7/1982 | Jabsen | 165/172 |
| 4,421,070 | 12/1983 | Sullivan | 122/510 |

*Primary Examiner*—Henry C. Yuen

*Attorney, Agent, or Firm*—Robert L. Olson

[57] ABSTRACT

An economizer (16) located in the rear pass (12) of a steam generator having a vertical tube panel containing a plurality of parallel, vertically spaced horizontal tube portions (22) and a support therefor including a pair of plates (32, 34), one positioned on either side of the tube panel. First tabs or bars (46) which are integral at one end (50) with the first plate (32) extend horizontally beneath and support every other, or alternate horizontal tube portions (22), and are welded (52) to the second plate (34) at their other ends. Second tabs or bars (44) which are integral at one end (48) with the second plate (34) extend horizontally beneath and support the remaining, alternate horizontal tube portions (22) not supported by the first bars (46), and are supported at their other ends by ledges (54) contained on the first plate (32).

3 Claims, 4 Drawing Figures

ECONOMIZER SUPPORT

BACKGROUND OF THE INVENTION

In steam generators, heating surface is normally disposed in the vertical rear pass leading from the furnace. The last heat exchange surface located within the rear pass is an economizer, where water flowing through the steam generating tubes is heated. Although the combustion gases passing over the economizer surface is relatively cool (not over 1500 F.), care must still be taken to support the horizontal runs of the internested sinuous or serpentine economizer tubes in a manner which will permit unequal thermal expansion to take place in the various horizontal tube runs, without placing undue stress in the tubes.

SUMMARY OF THE INVENTION

The economizer tube support of the invention for an economizer having a plurality of vertically spaced, horizontal tube runs includes typically a pair of vertical support plates, one being positioned on either side of the tube runs. A plurality of first tabs are punched out of a first one of the plates, and bent so as to extend horizontally beneath every other horizontal tube run. A plurality of second tabs are punched out of the second plate, and bent so as to extend horizontally beneath the alternating tube runs not supported by the first tabs. The first set of tabs extend through openings in the second plate, and are supported thereby. The second set of tabs extend through openings in the first plate, and are welded thereto.

DESCRIPTION OF THE PREFERRED EMBODIMENT

Figure 1:
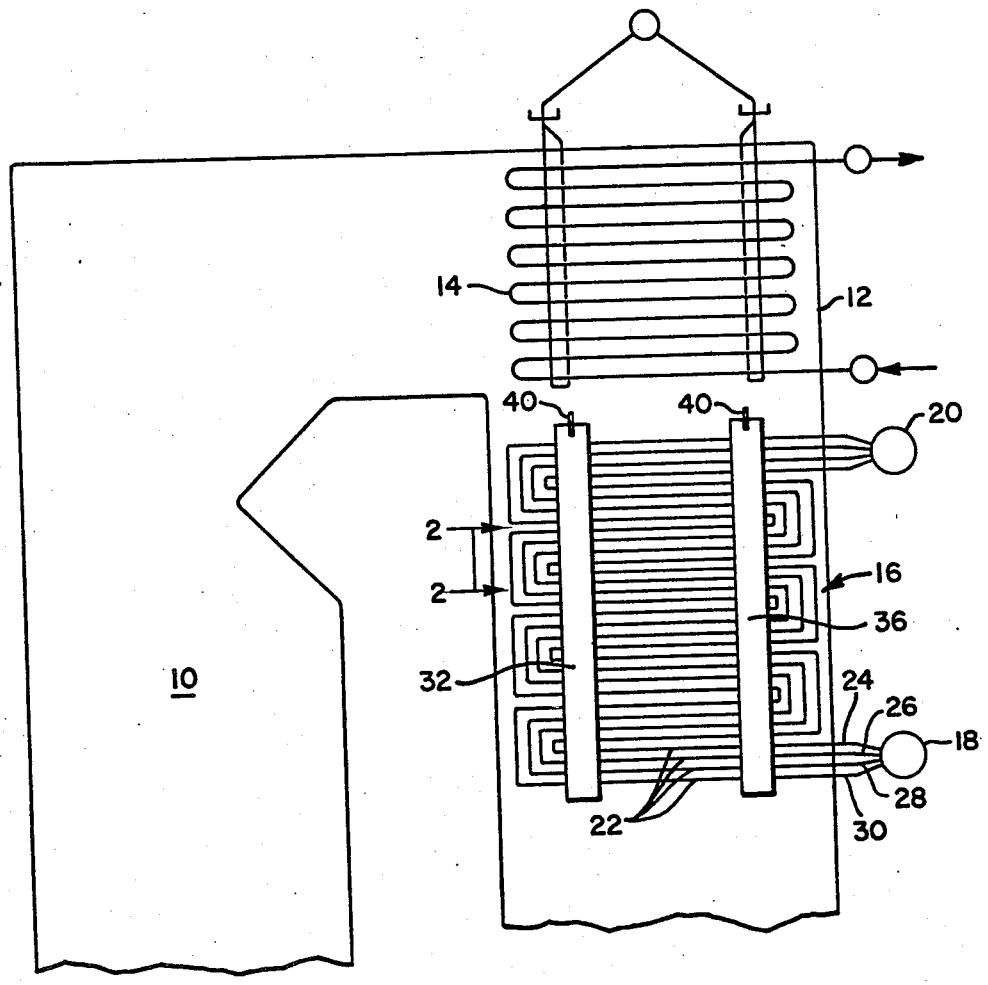
FIG. 1 is a schematic elevational section through a steam generator using the tube support of the invention.

Looking now to FIG. 1, numeral 10 designates the upper portion of a furnace of a steam generator in which fuel is burned to generate hot combustion gases. The gases, after flowing upwardly through the furnace, pass downwardly through a rear pass 12, first traversing a secondary superheater 14 and then passing over an economizer 16. The tubes of the economizer are supplied with water from a supply header 18, and heated water exit into header 20. There are a plurality of heat exchange panels 16 which are positioned in side-by-side relationship across the depth of the rear pass 12. The panels are made up of a plurality of internested, sinuous or serpentine tubes, each of which has horizontal runs 22. As shown, four tubes 24, 26, 28, and 30 are interested to form one panel of the economizer. The horizontal runs or sections 22 are supported by a pair of plates 32, 34, (FIG. 2) along the left-hand side (FIG. 1) of the panel. The right-hand side (FIG. 1), is also supported by a pair of plates, only one of which 36 can be seen. The plates are supported at their upper ends by members 40 which extend across the rear pass and are supported at each end by the rear pass walls.

Figure 4:
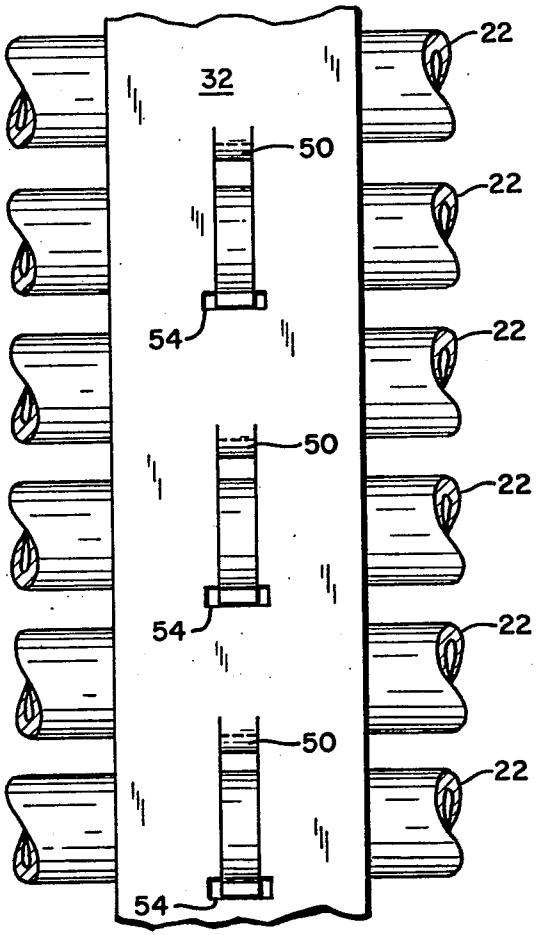
FIG. 4 is a view taken on line 4—4 of FIG. 2.
Figure 2:
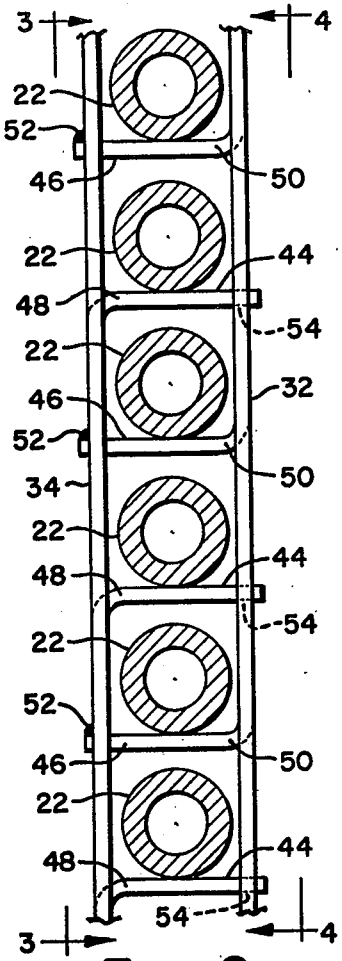
FIG. 2 is an enlarged view taken on line 2—2 of FIG. 1.
Figure 3:
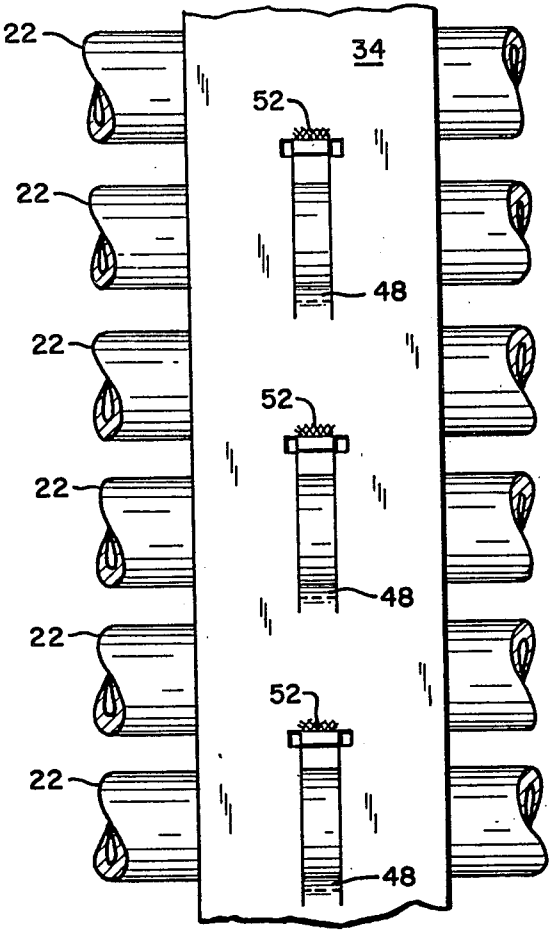
FIG. 3 is a view taken on line 3—3 of FIG. 2.

Looking now to FIGS. 2–4, the particular manner in which the horizontal runs of the economizer tubes are supported is shown in more detail. As can be seen in FIG. 2, each of the horizontal tube runs 22 is supported by a metal bar 44 or 46. The bars 44, which support alternate or every other tube, is integrally attached to the left-hand plate 34, as shown in FIGS. 2 and 3. These tabs or bars 44 are cut and pressed out of the metal making up the plate 34, and are integral with the plate at point 48. Likewise, the remaining or alternate tubes 22 are supported by bars 46, which are integral at 50 with the right-hand plate 32, as shown in FIGS. 2 and 4. The ends of the tabs or bars 44 fit into the openings in plate 32 when finally assembled. Likewise, the ends of bars 46 fit into the openings in plate 34. In order to give the support arrangement added rigidity and to keep the support arrangement held together, the tabs or bars 46 are tack welded at 52 to the plate 34. Since the ends of tabs or bars 44 are adequately supported on the ledges 54 of plate 32, they do not have to be welded. As can be seen, the ends of all of the tabs or bars 44 are supported by ledges 54 and that tabs 46 are welded at the top of the ledges at 52.

From the above it can be seen that an economizer support arrangement has been provided which is simple, inexpensive, and trouble-free. Plain tubes, as shown, or tubes with spiral or other fin attachments thereon, can be supported. The tube runs are supported in a manner which permits each horizontal tube run to move freely due to thermal expansion at different rates from that of its support, and also that of the adjacent tube runs without any undue stresses being created. The economizer panels and their supports can be both assembled and welded at the shop and shipped to the boiler site ready for installation. This saves time and money and also increases the quality assurance of the entire economizer. The plates 32 and 34 are identical (one being reversed, or turned upside down, from the other when assembled). This also reduces fabrication costs. Also, the welding necessary is kept to a bare minimum.

I claim:

1. In combination, a vertical gas pass through which hot combustion gases flow, a heat exchanger including a vertical tube panel having serpentine tube means, the tube means having a plurality of parallel, vertically spaced horizontal tube portions, support means for the tube panel, said support means including a pair of vertical plates, therebeing a first of the plates being on one side of the panel, and a second of the plates being on the other side of the panel, the first plate having a plurality of horizontal first bars integral at one end therewith, which extend beneath and support every other, or alternate horizontal tube portions, the other end of the first bars being supported by and welded to the second plate, and the second plate having a plurality of horizontal second bars integral at one end therewith which extend beneath and support the remaining, alternate horizontal tube portions not supported by the first bars, the other end of the second bars rests on and is supported by ledges on the first plate.

2. The combination set forth in claim 1, wherein the tube panel contains a plurality of internested, serpentine tubes.

3. The combination set forth in claim 2 wherein the heat exchanger is an economizer, located in the rear gas pass of a steam generator.

* * * * *